US012320532B2

(12) United States Patent
Jiang et al.

(10) Patent No.: US 12,320,532 B2
(45) Date of Patent: Jun. 3, 2025

(54) AIR CONDITIONING SYSTEM, AND HEAT EXCHANGE SYSTEM FOR HEAT DISSIPATION OF ELECTRONIC CONTROL ASSEMBLY OF AIR CONDITIONING SYSTEM

(71) Applicant: SANHUA (HANGZHOU) MICRO CHANNEL HEAT EXCHANGER CO., LTD., Zhejiang (CN)

(72) Inventors: Jianlong Jiang, Zhejiang (CN); Qiang Gao, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 267 days.

(21) Appl. No.: 17/781,547

(22) PCT Filed: Nov. 30, 2020

(86) PCT No.: PCT/CN2020/132942

§ 371 (c)(1),
(2) Date: Jun. 1, 2022

(87) PCT Pub. No.: WO2021/109975

PCT Pub. Date: Jun. 10, 2021

(65) Prior Publication Data

US 2023/0033824 A1 Feb. 2, 2023

(30) Foreign Application Priority Data

Dec. 3, 2019 (CN) ..... 201911223261.9
Dec. 3, 2019 (CN) ..... 201922141165.1

(51) Int. Cl.
*B60H 1/14* (2006.01)
*B60H 1/03* (2006.01)
(Continued)

(52) U.S. Cl.
CPC ..... *F24F 1/24* (2013.01); *F24F 13/30* (2013.01); *F28D 1/05316* (2013.01); *F28D 21/00* (2013.01); *F28D 2021/0029* (2013.01)

(58) Field of Classification Search
CPC ..... F28D 1/0426; F28D 7/0083; F28D 2001/0266; F28D 2001/0273;
(Continued)

(56) References Cited

U.S. PATENT DOCUMENTS 5,309,637 A * 5/1994 Moriarty ..... F28F 1/045 228/183
6,347,528 B1 * 2/2002 Iritani ..... B60H 1/3207 62/434
(Continued)

FOREIGN PATENT DOCUMENTS

CN 102062549 A 5/2011
CN 102480213 A 5/2012
(Continued)

OTHER PUBLICATIONS

International Search Report dated Feb. 21, 2021 for corresponding International Application No. PCT/CN2020/132942, Nov. 30, 2020.
(Continued)

*Primary Examiner* — Frantz F Jules
*Assistant Examiner* — Jason N Thompson
(74) *Attorney, Agent, or Firm* — David D. Brush; Westman, Champlin & Koehler, P.A.

(57) ABSTRACT

An air conditioning system includes a first system and a second system. The first system includes a compressor, a first heat exchanger, a second heat exchanger, an electronic control assembly, and a first throttle. The second system includes a first heat exchange assembly and a heat exchange member. The first heat exchange assembly includes a first channel and a second channel isolated from each other. A
(Continued)

second communication port of the first channel is in communication with a second opening of the compressor or a second opening of the second heat exchanger. A first communication port of the heat exchange member is in communication with a first communication port of the second channel. A second communication port of the heat exchange member is in communication with a second communication port of the second channel. The heat exchange member includes a heat dissipation surface in contact with the electronic control assembly.

9 Claims, 8 Drawing Sheets

(51) Int. Cl.

| | |
|---|---|
| ***F24F 1/24*** | (2011.01) |
| ***F24F 13/30*** | (2006.01) |
| ***F28D 1/02*** | (2006.01) |
| ***F28D 1/053*** | (2006.01) |
| ***F28D 7/00*** | (2006.01) |
| ***F28D 21/00*** | (2006.01) |

(58) Field of Classification Search
CPC .... F28D 7/0008; F28D 7/0016; F28D 7/0025; F28D 7/0033; F24F 1/20–1/24; B60H 1/034; B60H 1/143
See application file for complete search history.

(56) References Cited

U.S. PATENT DOCUMENTS

| | | | | |
|---|---|---|---|---|
| 6,540,015 | B1 * | 4/2003 | Kawachi | F28D 7/0025 165/906 |
| 11,549,762 | B2 * | 1/2023 | Pelletier | F28F 9/026 |
| 2006/0289150 | A1 | 12/2006 | Lee et al. | |
| 2008/0135211 | A1 | 6/2008 | Yassour | |
| 2015/0181756 | A1 * | 6/2015 | Sato | H01L 23/427 165/64 |
| 2017/0018825 | A1 * | 1/2017 | Grünwald | B60H 1/00278 |
| 2017/0197488 | A1 * | 7/2017 | Kim | H01M 10/625 |

FOREIGN PATENT DOCUMENTS

| | | | | |
|---|---|---|---|---|
| CN | 103604170 | A | 2/2014 | |
| CN | 103644685 | A | 3/2014 | |
| CN | 104661496 | A | 5/2015 | |
| CN | 204329389 | U | 5/2015 | |
| CN | 104848436 | A | 8/2015 | |
| CN | 106314066 | A | 1/2017 | |
| CN | 209689453 | U | 11/2019 | |
| JP | 2016065656 | A | 4/2016 | |
| WO | WO-2014036476 | A2 * | 3/2014 | F01K 25/08 |

OTHER PUBLICATIONS

Written Opinion of the International Searching Authority dated Feb. 21, 2021 for corresponding International Application No. PCT/CN2020/132942, filed Nov. 30, 2020.

Chinese Office Action dated Sep. 17, 2021 for corresponding Chinese Application No. 201911223261.9, filed Dec. 3, 2019.

First Chinese Office Action dated Sep. 17, 2021 for corresponding Chinese Application No. 201911223261.9, filed Dec. 3, 2019.

Second Chinese Office Action dated Feb. 14, 2022 for corresponding Chinese Application No. 201911223261.9, filed Dec. 3, 2019.

Third Chinese Office Action dated May 27, 2022 for corresponding Chinese Application No. 201911223261.9, filed Dec. 3, 2019.

English translation of the Written Opinion of the International Searching Authority dated Feb. 10, 2021 for corresponding International Application No. PCT/CN2020/132942, filed Nov. 30, 2020.

* cited by examiner

AIR CONDITIONING SYSTEM, AND HEAT EXCHANGE SYSTEM FOR HEAT DISSIPATION OF ELECTRONIC CONTROL ASSEMBLY OF AIR CONDITIONING SYSTEM

CROSS-REFERENCE TO RELATED APPLICATIONS

The present application is a national phase entry under 35 USC § 371 of International Application No. PCT/CN2020/132942, filed on Nov. 30, 2020, which claims the benefit of priority to Chinese Applications No. 201911223261.9 and 201922141165.1 filed on Dec. 3, 2019, all of which are incorporated by reference herein in their entireties for all purposes.

FIELD

Embodiments of the present disclosure relate to a field of heat exchange, and more particularly, to an air conditioning system and a heat exchange system for heat dissipation of an electronic control assembly of an air conditioning system.

BACKGROUND

An electronic control assembly of an air conditioning system is used to control the normal operation of the air conditioning system, and the electronic control assembly may generate heat during operation. In order to ensure the normal operation of the electronic control assembly, the heat generated needs to be taken away. As far as the applicant knows, a heat dissipation system of a controller includes a branch divided from the air conditioning system, so that a part of the refrigerant flows into a heat exchange member, so as to perform heat dissipation of the electronic control assembly through the heat exchange member. However, the refrigerant entering the heat exchange member is a refrigerant with a high temperature and a high pressure, and the temperature difference between the refrigerant and components of the electronic control assembly is small, so that the heat dissipation effect is poor. Moreover, if the refrigerant entering the heat exchange member is a refrigerant with a low temperature and a low pressure after passing through a throttle valve of a unit, the condensate tends to be generated due to the low temperature, which has potential safety hazards to the electronic control assembly.

SUMMARY

A heat exchange system for heat dissipation of an electronic control assembly of an air conditioning system according to embodiments of a first aspect of the present disclosure includes: a first heat exchange assembly including a first channel and a second channel isolated from each other, the second channel including a first communication port and a second communication port, the first heat exchange tube including a tube wall and a flow channel, the flow channel of the first heat exchange tube defining a part of the first channel, the second heat exchange tube including a tube wall and a flow channel, the flow channel of the second heat exchange tube defining a part of the second channel, and at least part of the tube wall of the second heat exchange tube is in contact with at least part of the tube wall of the first heat exchange tube; and a heat exchange member including a first communication port and a second communication port, the first communication port of the heat exchange member being in communication with the first communication port of the second channel, the second communication port of the heat exchange member being in communication with the second communication port of the second channel, the heat exchange member including at least one heat dissipation surface, and the heat dissipation surface being in contact with the electronic control assembly, so as to be in conduction with the electronic control assembly to dissipate heat. When the heat exchange system operates, the first channel is filled with a first refrigerant, the second channel is filled with a second refrigerant, and the first refrigerant in the first channel and the second refrigerant in the second channel remain separated from each other.

An air conditioning system according to embodiments of a second aspect of the present disclosure includes: a first system including a compressor, a first heat exchanger, a second heat exchanger, an electronic control assembly and a first throttle, the compressor including a first opening and a second opening, the first heat exchanger including a first opening and a second opening, the first throttle including a first opening and a second opening, the second heat exchanger including a first opening and a second opening, the first opening of the first heat exchanger being in communication with the first opening of the compressor, the second opening of the first heat exchanger being in communication with the first opening of the first throttle, the second opening of the first throttle being in communication with the second opening of the second heat exchanger, and the first opening of the second heat exchanger being in communication with the second opening of the compressor; and a second system including a first heat exchange assembly and a heat exchange member, the first heat exchange assembly including a first channel and a second channel isolated from each other. The first channel includes a first communication port and a second communication port, the first communication port of the first channel is in communication with the second opening of the first throttle or the second opening of the first heat exchanger, the second communication port of the first channel is in communication with the second opening of the compressor and the first opening of the second heat exchanger, or the second communication port of the first channel is in communication with the second opening of the second heat exchanger. The second channel includes a first communication port and a second communication port, the heat exchange member includes a first communication port and a second communication port, the first communication port of the heat exchange member is in communication with the first communication port of the second channel, the second communication port of the heat exchange member is in communication with the second communication port of the second channel, the heat exchange member includes at least one heat dissipation surface, and the heat dissipation surface is in contact with the electronic control assembly, so as to be in conduction with the electronic control assembly to dissipate heat. When the air conditioning system operates, the first system is filled with a first refrigerant, the second channel of the second system is filled with a second refrigerant, and the first refrigerant in the first system and the second refrigerant in the second system remain separated from each other.

DETAILED DESCRIPTION

Figure 1:
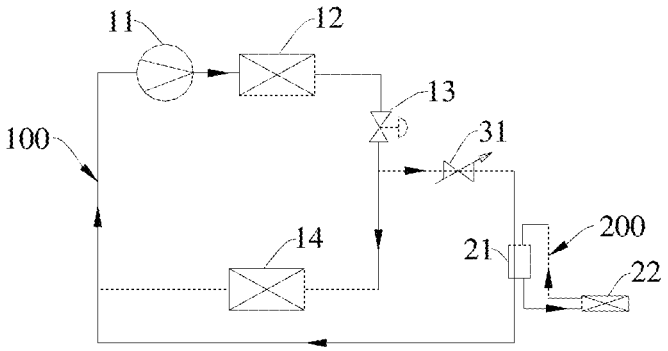
FIG. 1 is a schematic view of an air conditioning system according to an embodiment of the present disclosure.

Embodiments of the present disclosure are described in detail below, and examples of the embodiments are shown in accompanying drawings. The following embodiments described with reference to the accompanying drawings are exemplary and are only intended to explain the present disclosure, rather than limit the present disclosure. In the description of the present disclosure, it shall be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation and position as then described or as shown in the drawings under discussion. These relative terms are only for convenience of description and do not indicate or imply that the device or element referred to must have a particular orientation, or be constructed and operated in a particular orientation. Thus, these terms shall not be construed as limitation on the present disclosure.

As shown in FIGS. 1-22, an air conditioning system according to embodiments of the present disclosure includes a first system 100 and a second system 200.

The first system 100 includes a compressor 11, a first heat exchanger 12, a first throttle 13, a second heat exchanger 14 and an electronic control assembly 16. The compressor 11 includes a first opening and a second opening, the first heat exchanger 12 includes a first opening and a second opening, the first throttle 13 includes a first opening and a second opening, and the second heat exchanger 14 includes a first opening and a second opening. The first opening of the first heat exchanger 12 is in communication with the first opening of the compressor 11, the second opening of the first heat exchanger 12 is in communication with the first opening of the first throttle 13, the second opening of the first throttle 13 is in communication with the second opening of the second heat exchanger 14, and the first opening of the second heat exchanger 14 is in communication with the second opening of the compressor 11.

As shown in FIGS. 1 and 3-9, a right-end opening (shown in FIGS. 1, 5, 6 and 8) or an upper-end opening (shown in FIGS. 3, 4, 7 and 9) of the compressor 11 is in communication with a left-end opening of the first heat exchanger 12, a right-end opening of the first heat exchanger 12 is in communication with an upper-end opening of the first throttle 13, a lower-end opening of the first throttle 13 is in communication with a right-end opening of the second heat exchanger 14, and a left-end opening of the second heat exchanger 14 is in communication with a left-end opening (shown in FIGS. 1, 5, 6 and 8) or a lower-end opening (shown in FIGS. 3, 4, 7 and 9) of the compressor 11, so as to define a circulation loop in which a first refrigerant may circulate and flow.

The second system 200, i.e., a heat exchange system for heat dissipation of an electronic control assembly of an air conditioning system, includes a first heat exchange assembly 21 and a heat exchange member 22. The first heat exchange assembly 21 includes a first channel 211 and a second channel 212 isolated from each other, and the first channel 211 includes a first communication port and a second communication port. The first communication port of the first channel 211 is in communication with the second opening of the first throttle 13 or the second opening of the first heat exchanger 12. The second communication port of the first channel 211 is in communication with the second opening of the compressor 11 and the first opening of the second heat exchanger 14, or the second communication port of the first channel is in communication with the second opening of the second heat exchanger 14.

Figure 6:
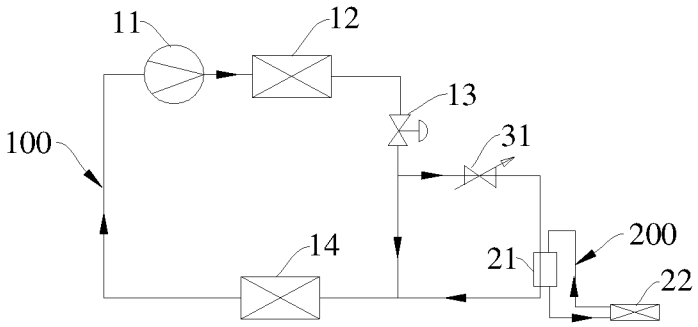
FIG. 6 is a schematic view of an air conditioning system according to yet another embodiment of the present disclosure.
Figure 7:
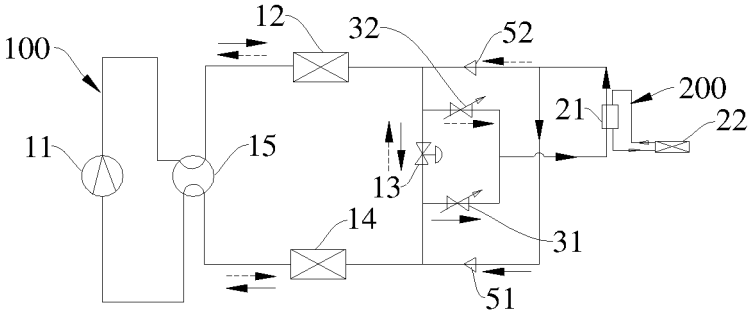
FIG. 7 is a schematic view of an air conditioning system according to still another embodiment of the present disclosure.
Figure 8:
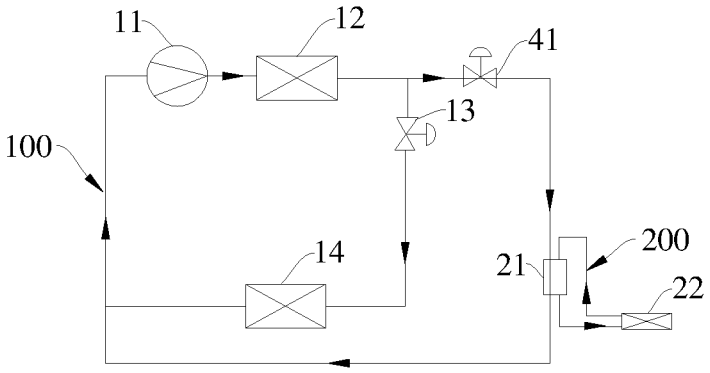
FIG. 8 is a schematic view of an air conditioning system according to yet another embodiment of the present disclosure.
Figure 9:
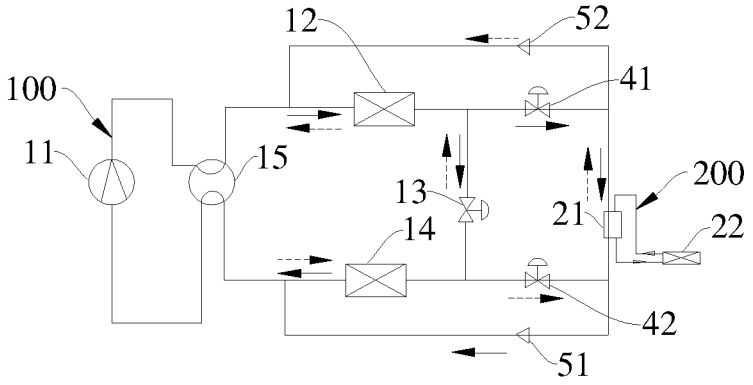
FIG. 9 is a schematic view of an air conditioning system according to still another embodiment of the present disclosure.

An upper-end communication port of the first channel 211 of the first heat exchange assembly 21 is in communication with the lower-end opening of the first throttle 13, as shown in FIGS. 1 and 3-7; or, the upper-end communication port of the first channel 211 of the first heat exchange assembly 21 is in communication with the right-end opening of the first heat exchanger 12, as shown in FIGS. 8 and 9.

Figure 3:
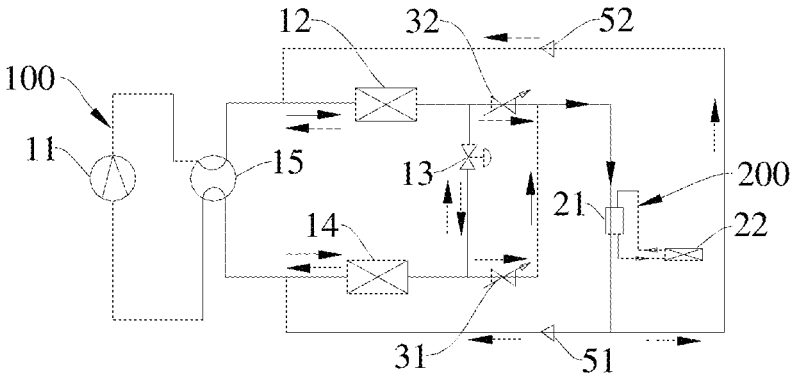
FIG. 3 is a schematic view of an air conditioning system according to another embodiment of the present disclosure.
Figure 4:
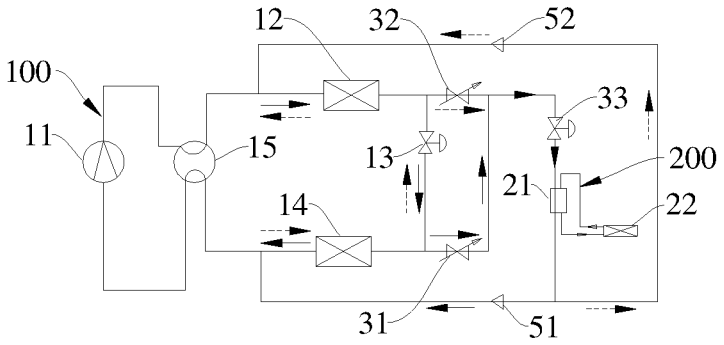
FIG. 4 is a schematic view of an air conditioning system according to still another embodiment of the present disclosure.
Figure 5:
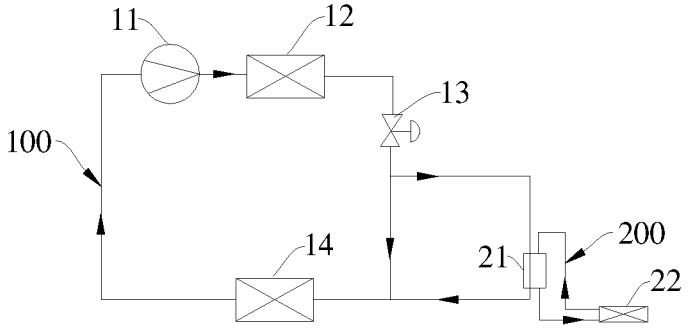
FIG. 5 is a schematic view of an air conditioning system according to still another embodiment of the present disclosure.

A lower-end communication port of the first channel 211 of the first heat exchange assembly 21 is in communication with the compressor 11, as shown in FIGS. 1, 3, 4, 8 and 9; or, the lower-end communication port of the first channel 211 of the first heat exchange assembly 21 is in communication with the right-end opening of the second heat exchanger 14, i.e., the lower-end communication port of the first channel 211 of the first heat exchange assembly 21 is in communication with the compressor 11 through the second heat exchanger 14, as shown in FIGS. 5-7. Thus, the first refrigerant flowing out of the first heat exchanger 12 is divided and flows into two paths. In one path, the first refrigerant flows into the second heat exchanger 14 and then enters the compressor 11. In the other path, the first refrigerant flows into the first channel 211 of the first heat exchange assembly 21, and directly enters the compressor 11 or flows into the second heat exchanger 14 and then enters the compressor 11, through the first channel 211.

The second channel 212 includes a first communication port 2126 and a second communication port 2127, and the heat exchange member 22 includes a first communication port 221 and a second communication port 222. The first communication port 221 of the heat exchange member 22 is in communication with the first communication port 2126 of the second channel 212, and the second communication port 222 of the heat exchange member 22 is in communication with the second communication port 2127 of the second channel 212. The heat exchange member 22 includes at least one heat dissipation surface 220, and the heat dissipation surface 220 is in contact with the electronic control assembly 16, so as to be in conduction with the electronic control assembly 16 to dissipate heat. Thus, the second system 200 is the heat exchange system for heat dissipation of the electronic control assembly 16 of the air conditioning system according to the embodiments of the present disclosure.

Figure 2:
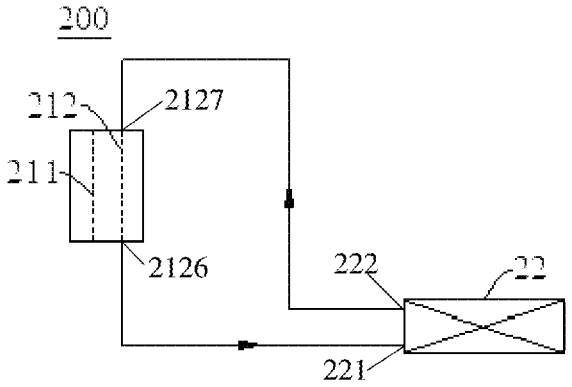
FIG. 2 is a schematic view of a second system (a heat exchange system for heat dissipation of an electronic control assembly of an air conditioning system) according to an embodiment of the present disclosure.

As shown in FIGS. 1 and 2, an upper-end communication port of the second channel 212 of the first heat exchange assembly 21 is in communication with a left-end upper communication port of the heat exchange member 22, and a lower-end communication port of the second channel 212 of the first heat exchange assembly 21 is in communication with a left-end lower communication port of the heat exchange member 22, so as to define another circulation loop in which a second refrigerant may circulate and flow.

The first channel 211 and the second channel 212 are isolated from each other. Moreover, when the air conditioning system operates, the first channel 211 is filled with the first refrigerant, the second channel 212 is filled with the second refrigerant, and the first refrigerant in the first channel 211 and the refrigerant in the second channel 212 remain separated from each other, i.e., they are not mixed with each other. Therefore, when the air conditioning system operates, the first refrigerant in the first system 100 and the second refrigerant in the second system 200 remain separated from each other. Furthermore, when the first refrigerant flows to the first channel 211, the first refrigerant exchanges heat with the second refrigerant in the second channel 212.

Figure 22:
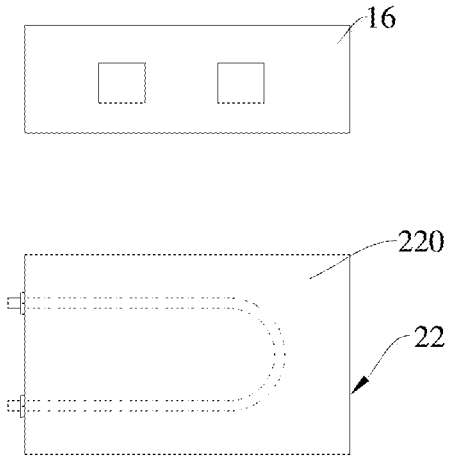
FIG. 22 is a schematic view of a heat exchange member and an electronic control assembly according to an embodiment of the present disclosure.
Figure 23:
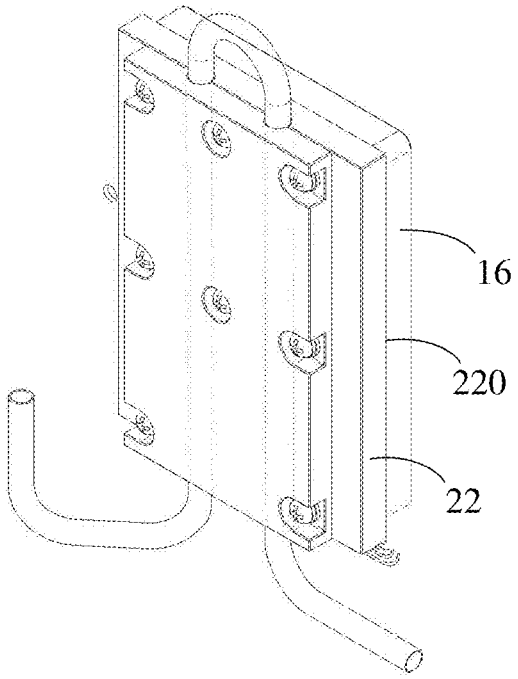
FIG. 23 is a schematic view of a heat exchange member and an electronic control assembly according to another embodiment of the present disclosure.

As shown in FIG. 22, the at least one heat dissipation surface 220 of the heat exchange member 22 is in contact with the electronic control assembly 16, so as to be in conduction with the electronic control assembly 16 to dissipate heat. Thus, the above another circulation loop is a heat exchange loop for heat dissipation of the electronic control assembly 16. The electronic control assembly 16 may be in direct contact with the at least one heat dissipation surface 220 of the heat exchange member 22 (as shown in FIG. 23) or may be in indirect contact with the at least one heat dissipation surface 220. The indirect contact means that in some applications, the electronic control assembly 16 is mounted on other components, and the electronic control assembly 16 is in contact with the heat exchange member 22 through the other components, so as to conduct heat.

The air conditioning system according to the embodiments of the present disclosure includes a first system 100 and a second system 200, the first system 100 includes a compressor 11, a first heat exchanger 12, a first throttle 13, a second heat exchanger 14 and an electronic control assembly 16, and the second system 200 includes a first heat exchange assembly 21 and a heat exchange member 22. The first heat exchange assembly 21 includes a first channel 211 and a second channel 212 isolated from each other, the first channel 211 is in communication with the first system 100, and the second channel 212 is in communication with the heat exchange member 22. Thus, the second refrigerant in the heat exchange member 22 absorbs heat of the electronic control assembly 16 and then enters the second channel 212, the second refrigerant in the second channel 212 exchanges heat with the first refrigerant in the first channel 211, and the second refrigerant after the heat exchange flows into the heat exchange member 22 again, so as to realize the heat dissipation of the electronic control assembly 16, thus improving the heat dissipation effect of the heat exchange member 22 on the electronic control assembly 16, enhancing the heat dissipation efficiency, and facilitating the improvement of the performance of the air conditioning system.

The first channel 211 and the second channel 211 are isolated from each other, and the first refrigerant in the first system 100 and the second refrigerant in the second system 200 are not mixed with each other, so that a flow rate of the first refrigerant in the first system 100 is stable, the superheat degree of the first refrigerant entering an evaporator of a unit is stable, and the efficiency of the system is improved. In addition, a temperature difference between the second refrigerant entering the heat exchange member 22 and the electronic control assembly 16 is relatively large, which improves the heat dissipation effect. Moreover, a temperature of the second refrigerant is relatively high, which reduces the generation of condensate on the electronic control assembly 16, thus improving the safety of the electronic control assembly 16.

In some embodiments, the air conditioning system further includes a first adjusting member 31, and the first adjusting member 31 includes a first opening and a second opening. The first opening of the first adjusting member 31 is in communication with the second opening of the first throttle 13, and the first opening of the first adjusting member 31 is in communication with the second opening of the second heat exchanger 14. The second opening of the first adjusting member 31 is in communication with the first communication port of the first channel 211 of the first heat exchange assembly 21.

In the embodiments shown in FIGS. 1, 3, 4, 6 and 7, the upper-end opening of the first throttle 13 is in communication with the right-end opening of the first heat exchanger 12, the lower-end opening of the first throttle 13 is in communication with the right-end opening of the second heat exchanger 14 and a left-end opening of the first adjusting member 31, respectively, and a right-end opening of the first adjusting member 31 is in communication with the upper-end communication port (as shown in FIGS. 1, 3, 4 and 6) or the lower-end communication port (as shown in FIG. 7) of the first channel 211 of the first heat exchange assembly 21.

In the embodiments shown in FIGS. 1, 5 and 6, the first system is a single stage refrigeration system, the first heat exchanger 12 is a condenser and the second heat exchanger 14 is an evaporator. The first refrigerant from the compressor 11 flows into the first heat exchanger 12, condenses in the first heat exchanger 12, and then is divided and flows into two paths after passing through the first throttle 13. In one path, the first refrigerant flows into the second heat exchanger 14, evaporates in the second heat exchanger 14, and then enters the compressor 11. In the other path, the first refrigerant flows into the first channel 211 of the heat exchange assembly 21 after passing through the first adjusting member 31 (shown in FIGS. 1 and 6), or directly flows into the first channel 211 of the heat exchange assembly 21 without passing through the first adjusting member 31 (shown in FIG. 5). The first refrigerant flowing out of the first channel 21 directly enters the compressor 11 (as shown in FIG. 1) or enters the compressor 11 after passing through the second heat exchanger 14 (as shown in FIGS. 5 and 6). Specifically, the first adjusting member 31 is an adjusting valve for adjusting a flow rate of the first refrigerant flowing into the first channel 211.

The first system 100 is not limited to the single stage refrigeration system. For example, in some embodiments, the first system 100 may also be a heat pump system. As shown in FIGS. 3, 4 and 7, the first system 100 further includes a flow direction converter 15, the first opening of the first heat exchanger 12 is in communication with the first opening of the compressor 11 through the flow direction converter 15, and the first opening of the second heat exchanger 14 is in communication with the second opening of the compressor 11 through the flow direction converter 15. Specifically, the flow direction converter 15 may be a four-way valve, and the present disclosure is not limited to this, as long as the flow direction of the first refrigerant in the first system can be changed.

The air conditioning system further includes a second adjusting member 32, a first control member 51 and a second control member 52. The second adjusting member 32 includes a first opening and a second opening. The first opening of the second adjusting member 32 is in communication with the second opening of the first heat exchanger 12 and the first opening of the first throttle 13, and the second opening of the second adjusting member 32 is in communication with the second opening of the first adjusting member 31 and the first communication port of the first channel 211.

The first control member 51 includes a first opening and a second opening, and the second control member 52 includes a first opening and a second opening. The second communication port of the first channel 211 is in communication with the first opening of the first control member 51 and the first opening of the second control member 52. The second opening of the first control member 51 is in communication with the first opening of the second heat exchanger 14 and the flow direction converter 15, or the second opening of the first control member 51 is in communication with the second opening of the second heat exchanger 14.

The second opening of the second control member 51 is in communication with the first opening of the first heat exchanger 12 and the flow direction converter 15, or the second opening of the second control member 51 is in communication with the second opening of the first heat exchanger 12.

When the air conditioning system operates, the first adjusting member 31 and the first control member 51 are in an open state simultaneously or in a closed state simultaneously, the second adjusting member 32 and the second control member 52 are in an open state simultaneously or in a closed state simultaneously, and the first adjusting member 31 and the second adjusting member 32 are not in the open state simultaneously.

As shown in FIGS. 3, 4 and 7, the left-end opening of the first adjusting member 31 is in communication with the lower-end opening of the first throttle 13 and the right-end opening of the second heat exchanger 14. The right-end opening of the first adjusting member 31 is in communication with the upper-end communication port (as shown in FIGS. 3 and 4) or the lower-end communication port (as shown in FIG. 7) of the first channel 211 of the first heat exchange assembly 21.

A left-end opening of the second adjusting member 32 is in communication with the right-end opening of the first heat exchanger 12 and the upper-end opening of the first throttle 13. A right-end opening of the second adjusting member 32 is in communication with the upper-end communication port (as shown in FIGS. 3 and 4) or the lower-end communication port (as shown in FIG. 7) of the first channel 211 of the first heat exchange assembly 21, and the right-end opening of the second adjusting member 32 is in communication with the right-end opening of the first adjusting member 31. Specifically, the second adjusting member 32 is also an adjusting valve for adjusting the flow rate of the first refrigerant flowing into the first channel 211.

Aright-end opening of the first control member 51 is in communication with the lower-end opening (as shown in FIGS. 3 and 4) or the upper-end opening (as shown in FIG. 7) of the first channel 211 of the first heat exchange assembly 21. A left-end opening of the first control member 51 is in communication with the flow direction converter 15 and the left-end opening of the second heat exchanger 14, as shown in FIGS. 3 and 4, or the left-end opening of the first control member 51 is in communication with the right-end opening of the second heat exchanger 14, as shown in FIG. 7. Specifically, the first control member 51 is a check valve or a stop valve.

A right-end opening of the second control member 51 is in communication with the lower-end opening (as shown in FIGS. 3 and 4) or the upper-end opening (as shown in FIG. 7) of the first channel 211 of the first heat exchange assembly 21, and is in communication with the right-end opening of the first control member 51. A left-end opening of the second control member 52 is in communication with the flow direction converter 15 and the left-end opening of the first heat exchanger 12, as shown in FIGS. 3 and 4, or the left-end opening of the first control member 52 is in communication with the right-end opening of the first heat exchanger 12, as shown in FIG. 7. The second control member 52 is a check valve or a stop valve.

When the air conditioning system is in use, the first adjusting member 31 and the first control member 51 are open, and the second adjusting member 32 and the second control member 52 are closed. The first refrigerant flows out of the compressor 11 and flows into the first heat exchanger 12 through the flow direction converter 15. After flowing out of the first heat exchanger 12 and passing through the first throttle 13, the first refrigerant is divided and flows into two paths. In one path, the first refrigerant flows into the second heat exchanger 14 and then enters the compressor 11 through the flow direction converter 15. In the other path, the first refrigerant flows into the first channel 211 of the first heat exchange assembly 21 through the first adjusting member 31 and, after flowing through and out of the first control member 51, the first refrigerant directly enters the compressor 11 through the flow direction converter 15 (in the embodiment shown in FIGS. 3 and 4) or flows into the second heat exchanger 14 first and then enters the compressor 11 through the flow direction converter 15 (in the embodiment shown in FIG. 7), as shown by the solid-line arrows in FIGS. 3, 4 and 7.

The second adjusting member 32 and the second control member 52 are open, and the first adjusting member 31 and the first control member 51 are closed. The first refrigerant flows out of the compressor 11 and flows into the second heat exchanger 14 through the flow direction converter 15. After flowing out of the second heat exchanger 14 and passing through the throttle valve 13, the first refrigerant is divided and flows into two paths. In one path, the first refrigerant flows into the first heat exchanger 12 and then enters the compressor 11 through the flow direction converter 15. In the other path, the first refrigerant flows into the first channel 211 of the first heat exchange assembly 21 through the second adjusting member 32 and, after flowing through and out of the second control member 52, the first refrigerant directly enters the compressor 11 through the flow direction converter 15 (in the embodiment shown in FIGS. 3 and 4) or flows into the first heat exchanger 12 first and then enters the compressor 11 through the flow direction converter 15 (in the embodiment shown in FIG. 7), as shown by the dotted-line arrows in FIGS. 3, 4 and 7.

The first heat exchanger 12 is a condenser and the second heat exchanger 14 is an evaporator. During refrigeration, the first adjusting member 31 and the first control member 51 are open, the second adjusting member 32 and the second control member 52 are closed, and a flow manner of the first refrigerant is shown by the solid-line arrows in FIGS. 3, 4 and 7. During heating, the second adjusting member 32 and the second control member 52 are open, the first adjusting member 31 and the first control member 51 are closed, and a flow manner of the first refrigerant is shown by the dotted-line arrows in FIGS. 3, 4 and 7.

In the embodiments shown in FIGS. 1, 3, 4, 6 and 7, the first adjusting member 31 may be replaced by a first on-off member. In other words, the air conditioning system includes the first on-off member. The first on-off member includes a first opening and a second opening, the first opening of the first on-off member is in communication with the second opening of the first throttle 13, and the first opening of the first on-off member is in communication with the second opening of the second heat exchanger 14. The second opening of the first on-off member is in communication with the first communication port of the first channel 211 of the first heat exchange assembly 21. The first on-off member has an on-off function, and may communicate the first channel 211 with the first throttle 13, or disconnect the first channel 211 from the first throttle 13.

Further, in the embodiments shown in FIGS. 3, 4 and 7, the second adjusting member 32 may be replaced by a second on-off member. In other words, the second on-off member includes a first opening and a second opening, the first opening of the second on-off member is in communication with the second opening of the first heat exchanger 12 and the first opening of the first throttle 13, and the second opening of the second on-off member is in communication with the second opening of the first adjusting member 31 and the first communication port of the first channel 211. The second on-off member has an on-off function, and may communicate the first channel 211 with the first throttle 13, or disconnect the first channel 211 from the first throttle 13.

In some specific embodiments, the air conditioning system further includes a second throttle 33, and the second throttle 33 includes a first opening and a second opening. The first opening of the second throttle 33 is in communication with the second opening of the first adjusting member 31 and the second opening of the second adjusting member 32, or the first opening of the second throttle is in communication with the second opening of the first on-off member and the second opening of the second on-off member. The second opening of the second throttle 33 is in communication with the first communication port of the first channel 211.

As shown in FIG. 4, an upper-end opening of the second throttle 33 is in communication with the right-end opening of the first adjusting member 31 and with the right-end opening of the second adjusting member 32. Alternatively, the upper-end opening of the second throttle 33 is in communication with a right-end opening of the first on-off member and with a right-end opening of the second on-off member. A lower-end opening of the second throttle 33 is in communication with the upper-end opening of the first channel 211 of the first heat exchange assembly 21. Therefore, a branch where the first channel 211 of the first heat exchange assembly 21 is located is individually controlled by the second throttle 33. Thus, by designing a resistance of this branch, an evaporation pressure of the first heat exchange assembly 21 is different from an evaporation pressure of the evaporator of the first heat exchanger 12 or the second heat exchanger 14, and the pressure of the first heat exchange assembly 21 is adjusted by adjusting the second throttle 33, so as to control a temperature of the heat exchange member 22.

The branch divided from the first system 100 is not limited to this. For example, in some embodiments, the air conditioning system further includes a third throttle 41, and the third throttle 41 includes a first opening and a second opening. The first opening of the third throttle 41 is in communication with the second opening of the first heat exchanger 12, and the second opening of the third throttle 42 is in communication with the first communication port of the first channel 211.

As shown in FIGS. 8 and 9, a left-end opening of the third throttle 41 is in communication with the right-end opening of the first heat exchanger 12. A right-end opening of the third throttle 41 is in communication with the upper-end communication port of the first channel 211 of the first heat exchange assembly 21.

In the embodiment shown in FIG. 8, the first system is a single stage refrigeration system, the first heat exchanger 12 is a condenser and the second heat exchanger 14 is an evaporator. The first refrigerant from the compressor 11 flows into the first heat exchanger 12, condenses in the first heat exchanger 12, and is divided and flows into two paths. In one path, the first refrigerant flows into the second heat exchanger 14 through the first throttle 13, evaporates in the second heat exchanger 14 and then enters the compressor 11. In the other path, the first refrigerant flows into the first channel 211 of the heat exchange assembly 21 through the third throttle 41, and the first refrigerant flowing out of the first channel 21 directly enters the compressor 11. Specifically, the third throttle 41 is an expansion valve or a throttle valve for throttling the first refrigerant flowing out of the first heat exchanger 12.

It can be understood that the first system of the present disclosure is not limited to the single stage refrigeration system. For example, in some embodiments, the first system may also be a heat pump system.

The first system 100 is not limited to the single stage refrigeration system. For example, in some embodiments, the first system 100 may also be the heat pump system. For example, in some specific embodiments, as shown in FIG. 9, the first system 100 further includes the flow direction converter 15, the first opening of the first heat exchanger 12 is in communication with the first opening of the compressor 11 through the flow direction converter 15, and the first opening of the second heat exchanger 14 is in communication with the second opening of the compressor 11 through the flow direction converter 15. Specifically, the flow direction converter 15 may be a four-way valve, and the present disclosure is not limited to this, as long as the flow direction of the first refrigerant in the first system can be changed.

The air conditioning system further includes a fourth throttle 42, the first control member 51 and the second control member 52. The fourth throttle 42 includes a first opening and a second opening. The first opening of the fourth throttle 42 is in communication with the second opening of the second heat exchanger 14, and the second opening of the fourth throttle 42 is in communication with the first communication port of the first channel 211.

The first control member 51 includes the first opening and the second opening, and the second control member 52 includes the first opening and the second opening. The first opening of the first control member 51 is in communication with the second opening of the fourth throttle 42 and the second communication port of the first channel 211. The second opening of the first control member 51 is in communication with the first opening of the second heat exchanger 14 and the flow direction converter 15, or the second opening of the first control member 51 is in communication with the second opening of the second heat exchanger 14.

The first opening of the second control member 52 is in communication with the second opening of the third throttle 41 and the first communication port of the first channel 211. The second opening of the second control member 52 is in communication with the first opening of the first heat exchanger 11 and the flow direction converter 15, or the second opening of the second control member 52 is in communication with the second opening of the first heat exchanger 12.

When the air conditioning system operates, the third throttle 41 and the first control member 51 are in an open state simultaneously or in a closed state simultaneously, the fourth throttle 42 and the second control member 52 are in an open state simultaneously or in a closed state simultaneously, and the third throttle 41 and the fourth throttle 42 are not in the open state simultaneously.

As shown in FIG. 9, the left-end opening of the third throttle 41 is in communication with the right-end opening of the first heat exchanger 12 and with the upper-end opening of the first throttle 13. The right-end opening of the third throttle 41 is in communication with the upper-end communication port of the first channel 211 of the first heat exchange assembly 21. A left-end opening of the fourth throttle 42 is in communication with the right-end opening of the second heat exchanger 14. A right-end opening of the fourth throttle 42 is in communication with the lower-end communication port of the first channel 211 of the first heat exchange assembly 21. Specifically, the fourth throttle 42 is a throttle valve or an expansion valve for throttling the first refrigerant flowing out of the second heat exchanger 12.

The right-end opening of the first control member 51 is in communication with the lower-end opening of the first channel 211 of the first heat exchange assembly 21. The left-end opening of the first control member 51 is in communication with the flow direction converter 15 and the left-end opening of the second heat exchanger 14. Specifically, the first control member 51 is a check valve or a stop valve.

The right-end opening of the second control member 51 is in communication with the upper-end opening of the first channel 211 of the first heat exchange assembly 21. The left-end opening of the second control member 52 is in communication with the flow direction converter 15 and the left-end opening of the first heat exchanger 12. Specifically, the second control member 52 is a check valve or a stop valve.

When the air conditioning system is in use, the third throttle 41 and the first control member 51 are open, and the fourth throttle 42 and the second control member 52 are closed. The first refrigerant flows out of the compressor 11 and flows into the first heat exchanger 12 through the flow direction converter 15. After flowing out of the first heat exchanger 12, the first refrigerant is divided and flows into two paths. In one path, the first refrigerant flows into the second heat exchanger 14 through the first throttle 13 and then enters the compressor 11 through the flow direction converter 15. In the other path, the first refrigerant flows into the first channel 211 of the first heat exchange assembly 21 through the third throttle 41 and, after flowing through and out of the first control member 51, the first refrigerant directly enters the compressor 11 through the flow direction converter 15, as shown by the solid-line arrows in FIG. 9.

The fourth throttle 42 and the second control member 52 are open, and the third throttle 41 and the first control member 51 are closed. The first refrigerant flows out of the compressor 11 and flows into the second heat exchanger 14 through the flow direction converter 15. After flowing out of the second heat exchanger 14, the first refrigerant is divided and flows into two paths. In one path, the first refrigerant flows into the first heat exchanger 12 through the throttle valve 13 and then enters the compressor 11 through the flow direction converter 15. In the other path, the first refrigerant flows into the first channel 211 of the first heat exchange assembly 21 through the fourth throttle 42, and after flowing through and out of the second control member 52, the first refrigerant directly enters the compressor 11 through the flow direction converter 15, as shown by the dotted-line arrows in FIG. 9.

The first heat exchanger 12 is a condenser and the second heat exchanger 14 is an evaporator. During refrigeration, the third throttle 41 and the first control member 51 are open, the fourth throttle 42 and the second control member 52 are closed, and a flow manner of the first refrigerant is shown by the solid-line arrows in FIG. 9. During heating, the fourth throttle 42 and the second control member 52 are open, the third throttle 41 and the first control member 51 are closed, and a flow manner of the first refrigerant is shown by the dotted-line arrows in FIG. 9.

The first heat exchange assembly 21 and the heat exchange member 22 of the second system 200 are described below with reference to FIGS. 1-20.

In some embodiments, when the air conditioning system is in use, the second communication port 2127 of the second channel 212 is not lower than the first communication port 2126 of the second channel 212 in a gravity direction, and the second communication port 222 of the heat exchange member 22 is not lower than the first communication port 221 of the heat exchange member 22 in the gravity direction. The second communication port 222 of the heat exchange member 22 is lower than the second communication port 2127 of the second channel 212 in the gravity direction, and the first communication port 221 of the heat exchange member 22 is lower than the first communication port 2126 of the second channel 212 in the gravity direction.

As shown in FIG. 2, the upper-end communication port of the second channel 212 is in communication with the left-end upper communication port of the heat exchange member 22, and the upper-end communication port of the second channel 212 is located above the left-end upper communication port of the heat exchange member 22. The lower-end communication port of the second channel 212 is in communication with the left-end lower communication port of the heat exchange member 22, and the upper-end communication port of the second channel 212 is located above the left-end lower communication port of the heat exchange member 22. Thus, the refrigerant in the second channel 212 can flow from the lower-end communication port of the second channel 212 to the left-end lower communication port of the heat exchange member 22 under the action of self-weight, and enter the heat exchange member 22. The principle of a gravity heat tube is adopted, so as to realize the circulation and heat exchange of the refrigerant.

Figure 10:
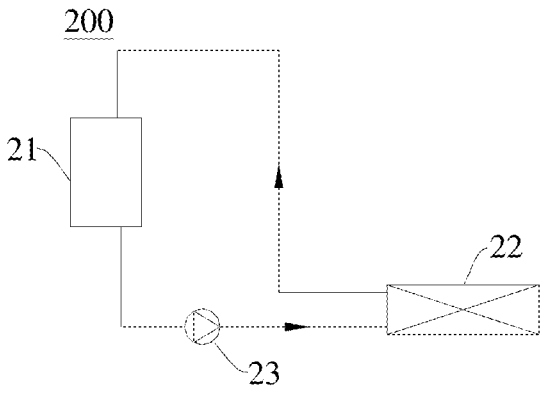
FIG. 10 is a schematic view of a second system (a heat exchange system for heat dissipation of an electronic control assembly of an air conditioning system) according to another embodiment of the present disclosure.

It can be understood that the present disclosure is not limited to the principle of the gravity heat tube. For example, in some embodiments, as shown in FIG. 10, a fluorine pump 23 is arranged between the first communication port 2126 of the second channel 212 and the first communication port 221 of the heat exchange member 22, so that the circulation and heat exchange of the refrigerant are driven by the fluorine pump 23.

In some embodiments, the heat exchange member 22 further includes a third communication port and a fourth communication port, the third communication port of the heat exchange member 22 is in communication with the first communication port 221 of the heat exchange member 22, and the fourth communication port of the heat exchange member 22 is in communication with the second communication port of the heat exchange member 22.

The second system 200 further includes a second heat exchange assembly 24, and the second heat exchange assembly 24 includes a first communication port and a second communication port. The first communication port of the second heat exchange assembly 24 is in communication with the third communication port of the heat exchange member 22, and the second communication port of the second heat exchange assembly 24 is in communication with the fourth communication port of the heat exchange member 22.

Figure 11:
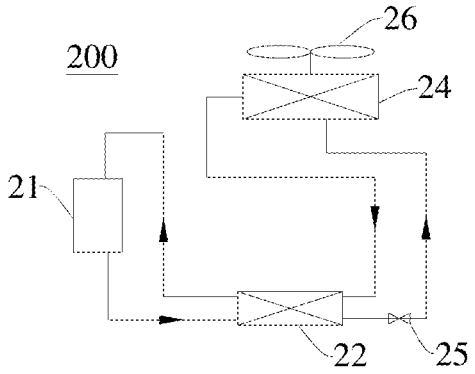
FIG. 11 is a schematic view of a second system (a heat exchange system for heat dissipation of an electronic control assembly of an air conditioning system) according to still another embodiment of the present disclosure.

As shown in FIG. 11, a right-end lower communication port of the heat exchange member 22 is in communication with the left-end lower communication port of the heat exchange member 22, and a right-end upper communication port of the heat exchange member 22 is in communication with the left-end upper communication port of the heat exchange member 22. A left-end communication port of the second heat exchange assembly 24 is in communication with the right-end upper communication port of the heat exchange member 22, and the lower-end communication port of the second heat exchange assembly 24 is in communication with the right-end lower communication port of the heat exchange member 22. Thus, the lower-end communication port of the second channel 212, the left-end lower communication port of the heat exchange member 22, the right-end lower communication port of the heat exchange member 22, the lower-end communication port of the second heat exchange assembly 24, the left-end communication port of the second heat exchange assembly 24, the right-end upper communication port of the heat exchange member 22, the left-end upper communication port of the heat exchange member 22 and the upper-end communication port of the second channel 212 are sequentially in communication with each other, so as to define a circulation loop. The refrigerant in the heat exchange member 22 absorbs the heat of the electronic control assembly 16, then evaporates and flows into the second heat exchange assembly 24. After passing through the second heat exchange assembly 24, the refrigerant flows into the heat exchange member 22 again and flows out of the heat exchange member 22 into the second channel 212.

Specifically, the second heat exchange assembly 24 is a condenser and may be used as a natural cooling module. When the ambient temperature is lower than a certain set value, the refrigerant after absorbing the heat of the electronic control assembly 16 first flows into the second heat exchange assembly 24 to condense into a liquid refrigerant, and then the liquid refrigerant flows into the heat exchange member 22 again.

In some specific embodiments, the second system 200 further includes a stop valve 25, and stop valve 25 is arranged between the third communication port of the heat exchange member 22 and the first communication port of the second heat exchange assembly 24. As shown in FIG. 11, the stop valve 25 is arranged between the right-end lower communication port of the heat exchange member 22 and the lower-end communication port of the second heat exchange assembly 24.

When the ambient temperature is high, the stop valve 25 is closed, and the refrigerant after absorbing the heat of the electronic control assembly 16 directly flows into the second channel 212, so as to exchange heat with the refrigerant in the first channel 211. When the ambient temperature is lower than a certain set value, the stop valve 25 is open, and the refrigerant after absorbing the heat of the electronic control assembly 16 first flows into the second heat exchange assembly 24 to condense into a liquid refrigerant, and then the liquid refrigerant flows into the heat exchange member 22 again. The refrigerant flowing out of the heat exchange member 22 flows into the second channel 212 again, so as to exchange heat with the refrigerant in the first channel 211.

In some specific embodiments, the second system 200 further includes a blower or a fan 26, the second heat exchange assembly 24 is arranged adjacent to the blower or the fan 26, and an air outlet of the blower or the fan 26 faces towards a windward side of the second heat exchange assembly 24. As shown in FIG. 11, the second heat exchange assembly 24 is adjacent to the blower or the fan 26 and located on a right side of the blower or the fan 26. The blower or the fan 26 has an air outlet, the second heat exchange assembly 24 has a windward side and a leeward side, and the windward side of the second heat exchange assembly 24 faces toward the air outlet of the blower or the fan 26, so that the wind blown by the blower or the fan 26 through the air outlet may enter the first heat exchange assembly 2.

Thus, under the action of the blower or the fan 26, a gaseous refrigerant in the second heat exchange assembly 24 may liquefy speedily into a liquid refrigerant, thus improving the heat exchange performance of the second heat exchange assembly 24 and improving the heat exchange effect of the system.

In some embodiments, the first heat exchange assembly 21 includes a first heat exchange tube 2111 and a second heat exchange tube 2121, the first heat exchange tube 2111 includes a tube wall and a flow channel, and the flow channel of the first heat exchange tube 2111 defines at least part of the first channel 211.

The second heat exchange tube 2121 includes a tube wall and a flow channel, and the flow channel of the second heat exchange tube 2121 defines at least part of the second channel 212. At least part of the tube wall of the second heat exchange tube 2121 is in contact with at least part of the tube wall of the first heat exchange tube 2111, or the second heat exchange tube 2121 is arranged in the flow channel of the first heat exchange tube 2111.

Figure 20:
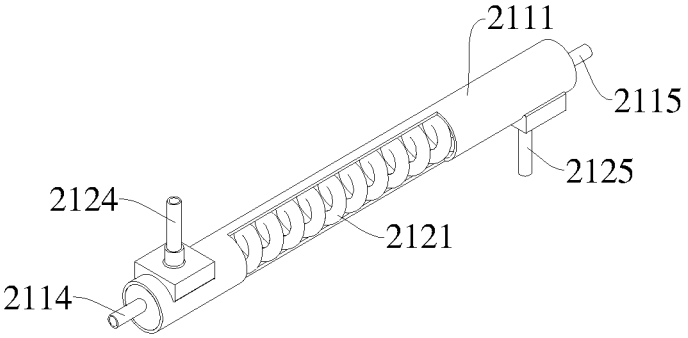
FIG. 20 is a schematic view of a first heat exchange assembly according to still another embodiment of the present disclosure.
Figure 21:
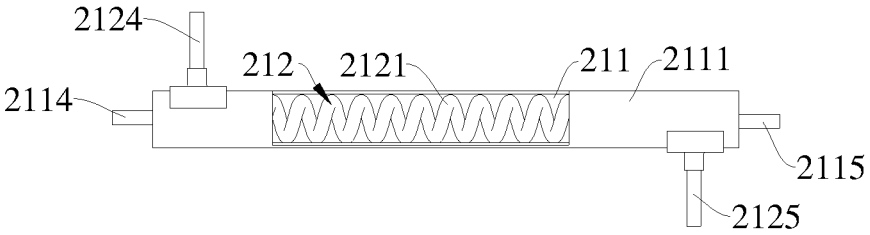
FIG. 21 is a front view of the first heat exchange assembly in FIG. 20.

As shown in FIGS. 12-19, the flow channel of the first heat exchange tube 2111 defines a part of the first channel 211, the flow channel of the second heat exchange tube 2121 defines a part of the second channel 212, and a part of the tube wall of the second heat exchange tube 2121 is in contact with at least part of the tube wall of the first heat exchange tube 2111. As shown in FIGS. 20 and 21, the flow channel of the first heat exchange tube 2111 is the first channel 211, the flow channel of the second heat exchange tube 2121 is the second channel 212, and the second heat exchange tube 2121 is arranged in the flow channel of the first heat exchange tube 2111.

In some embodiments, the first heat exchange assembly 21 further includes a first header 2112 and a second header 2113, as well as a third header 2122 and a fourth header 2123. The first header 2112 and the second header 2113 are spaced apart from each other, one end of at least one first heat exchange tube 2111 in a length direction of this first heat exchange tube 2111 is connected to the first header 2112, and the other end of this first heat exchange tube 2111 in the length direction of this first heat exchange tube 2111 is connected to the second header 2113, so as to communicate the first header 2112 with the second header 2113. The third header 2122 and the fourth header 2123 are spaced apart from each other, one end of at least one second heat exchange tube 2121 in a length direction of this second heat exchange tube 2121 is connected to the third header 2122, and the other end of this second heat exchange tube 2121 in the length direction of this second heat exchange tube 2121 is connected to the fourth header 2123, so as to communicate the third header 2122 with the fourth header 2123.

As shown in FIGS. 12-19, a length direction of the first header 2112, a length direction of the second header 2113, a length direction of the third header 2122 and a length direction of the fourth header 2123 are each a left-right direction. The first header 2112 and the second header 2113 are parallel to and spaced apart from each other, and a plurality of first heat exchange tubes 2111 are connected between the first header 2112 and the second header 2113, so as to communicate the first header 2112 with the second header 2113. The third header 2122 and the fourth header 2123 are parallel to and spaced apart from each other, and a plurality of second heat exchange tubes 2121 are connected between the third header 2122 and the fourth header 2123, so as to communicate the third header 2122 with the fourth header 2123.

Further, the first heat exchange assembly 21 further includes a first connecting tube 2114 and a second connecting tube 2115, as well as a third connecting tube 2124 and a fourth connecting tube 2125. The first connecting tube 2114 is connected to the first header 2112, and the second connecting tube 2115 is connected to the second header 2113. The third connecting tube 2124 is connected to the third header 2122, and the fourth connecting tube 2125 is connected to the fourth header 2123.

A flow channel of the first connecting tube 2114, a flow channel of the first header 2112, the flow channel of the first heat exchange tube 2111, a flow channel of the second header 2113 and a flow channel of the second connecting tube 2115 define the first channel 211. A flow channel of the third connecting tube 2124, a flow channel of the third header 2122, the flow channel of the second heat exchange tube 2121, a flow channel of the fourth header 2123 and a flow channel of the fourth connecting tube 2125 define the second channel 212.

In some embodiments, the first heat exchange tube 2111 and the second heat exchange tube 2121 are each a flat tube. The first heat exchange tube 2111 and the second heat exchange tube 2121 each include a first side face 21111 and a second side face 21112 arranged opposite to each other and a third side face 21113 and a fourth side face 21114 arranged opposite to each other. A distance between the first side face 21111 and the second side face 21112 of the first heat exchange tube 2111 is less than a distance between the third side face 21113 and the fourth side face 21114 of the first heat exchange tube 2111. A distance between the first side face 21111 and the second side face 21112 of the second heat exchange tube 2121 is less than a distance between the third side face 21113 and the fourth side face 21114 of the second heat exchange tube 2121. The first heat exchange tube 2111 and the second heat exchange tube 2121 each further include a plurality of flow channels spaced apart from each other. At least part of the first side face 21111 or the second side face 21112 of the first heat exchange tube 2111 is in contact with at least part of the first side face 21111 or the second side face 21112 of the second heat exchange tube 2121.

In some embodiments, a plurality of first heat exchange tubes 2111 and a plurality of second heat exchange tubes 2121 are provided, the plurality of first heat exchange tubes 2111 are arranged along a width direction of the first heat exchange tube 2111, and the plurality of second heat exchange tubes 2121 are arranged along a width direction of the second heat exchange tube 2121. An included angle between the length direction of the first heat exchange tube 2111 and the length direction of the second heat exchange tube 2121 is greater than 0 degrees and less than 180 degrees. Alternatively, the length direction of the first heat exchange tube 2111 is substantially parallel to the length direction of at least part of the second heat exchange tube 2121.

Figure 12:
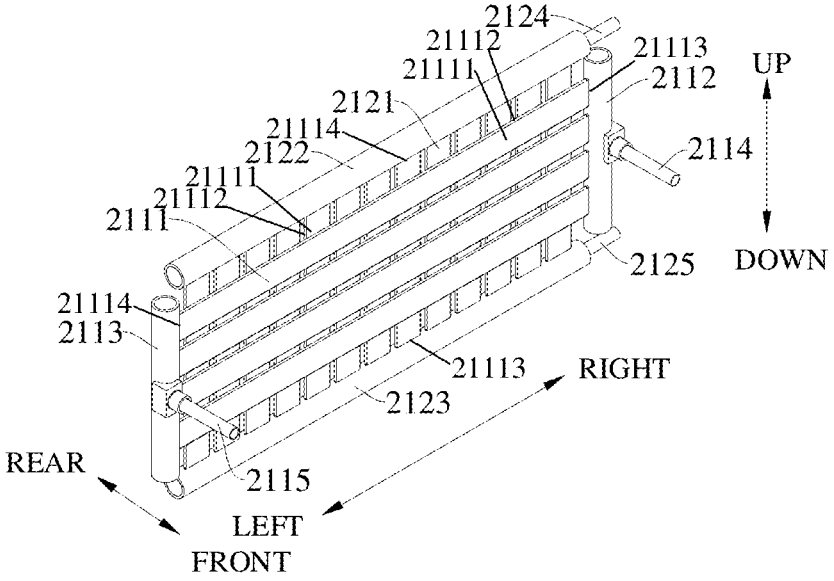
FIG. 12 is a schematic view of a first heat exchange assembly according to an embodiment of the present disclosure.
Figure 13:
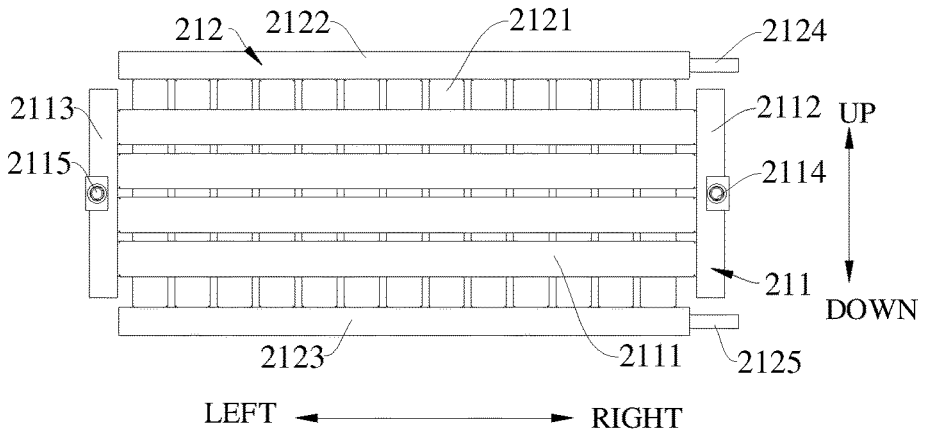
FIG. 13 is a front view of the first heat exchange assembly in FIG. 12.

In some specific embodiments, the length direction of the first heat exchange tube 2111 is perpendicular to the length direction of the second heat exchange tube 2121, and the first side face 21111 or the second side face 21112 of each second heat exchange tube 2121 is in contact with the first side faces 21111 or the second side faces 21112 of the plurality of first heat exchange tubes 2111. As shown in FIGS. 12 and 13, the width direction of the first heat exchange tube 2111 is an up-down direction, and the plurality of first heat exchange tubes 2111 are arranged side by side in the up-down direction. The width direction of the second heat exchange tube 2121 is the left-right direction, and the plurality of second heat exchange tubes 2121 are arranged side by side in the left-right direction. A rear side face of each first heat exchange tube 2111 is in contact with part of front side faces of the plurality of second heat exchange tubes 2121.

Figure 14:
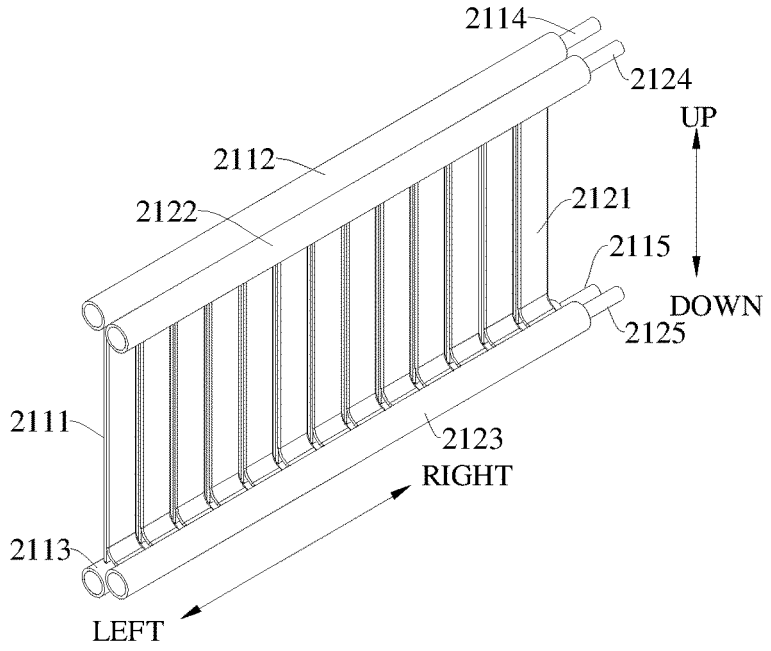
FIG. 14 is a schematic view of a first heat exchange assembly according to another embodiment of the present disclosure.
Figure 15:
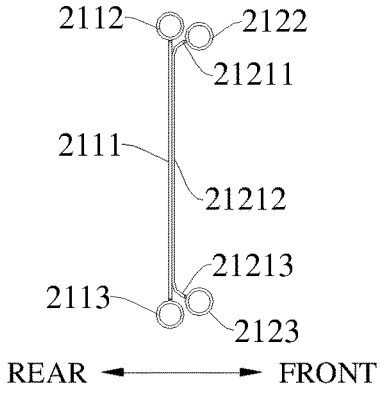
FIG. 15 is a side view of the first heat exchange assembly in FIG. 14.

It can be understood that the arrangement manner of the first heat exchange tube 2111 and the second heat exchange tube 2121 of the present disclosure is not limited to this. For example, as shown in FIGS. 14 and 15, the width direction of the first heat exchange tube 2111 and the width direction of the second heat exchange tube 2121 are each the left-right direction, the plurality of first heat exchange tubes 2111 are arranged side by side in the left-right direction, and the plurality of second heat exchange tubes 2121 are arranged side by side in the left-right direction. Each first heat exchange tube 2111 corresponds to one second heat exchange tube 2121, and the front side face of the first heat exchange tube 2111 is in contact with the rear side face of the second heat exchange tube 2121.

In some specific embodiments, the second heat exchange tube 2121 includes a first section 21211, a second section 21213 and an intermediate section 21212 located between the first section 21211 and the second section 21213. The first section 21211 is in communication with the intermediate section 21212 through a first bent portion, and the second section 21213 is in communication with the intermediate section 21212 through a second bent portion. A length direction of the first section 21211 is not collinear with a length direction of the intermediate section 21212, a length direction of the second section 21213 is not collinear with the length direction of the intermediate section 21212, and the length direction of the intermediate section 21212 is parallel to the length direction of the first heat exchange tube 2111.

A first side face or a second side face of the intermediate section 21212 of the second heat exchange tube 2121 is in contact with the first side face 21111 or the second side face 21112 of the first heat exchange tube 2111, and the intermediate section 21212 of each second heat exchange tube 2121 corresponds to one first heat exchange tube 2111.

As shown in FIGS. 14 and 15, the length direction of the first heat exchange tube 2111 is the up-down direction. A segment of the second heat exchange tube 2121 adjacent to an upper end is bent frontwards, and a segment of the second heat exchange tube 2121 adjacent to a lower end is also bent frontwards, so as to form the first section 21211, the first bent portion, the intermediate section 21212, the second bent portion and the second section 21213 sequentially arranged from top to bottom. The length direction of the intermediate section 21212 is the up-down direction. A rear side face of the intermediate section 21212 of each second heat exchange tube 2121 is in contact with the front side face of the corresponding first heat exchange tube 2111.

It can be understood that the first heat exchange tube 2111 and the second heat exchange tube 2121 of the present disclosure are not limited to what is shown in FIGS. 11-14. For example, in some embodiments, a plurality of first heat exchange tubes 2111 and a plurality of second heat exchange tubes 2121 are provided, the plurality of first heat exchange tubes 2111 are arranged along a thickness direction of the first heat exchange tube 2111, and the plurality of second heat exchange tubes 2121 are arranged along a thickness direction of the second heat exchange tube 2121. The thickness direction of the first heat exchange tube 2111 is substantially parallel to the thickness direction of the second heat exchange tube 2121, the first heat exchange tube 2111 and the second heat exchange tube 2121 are arranged alternately along the thickness direction of the first heat exchange tube 2111, and the length direction of the first heat exchange tube 2111 is parallel to the length direction of at least part of the second heat exchange tube 2121.

Figure 16:
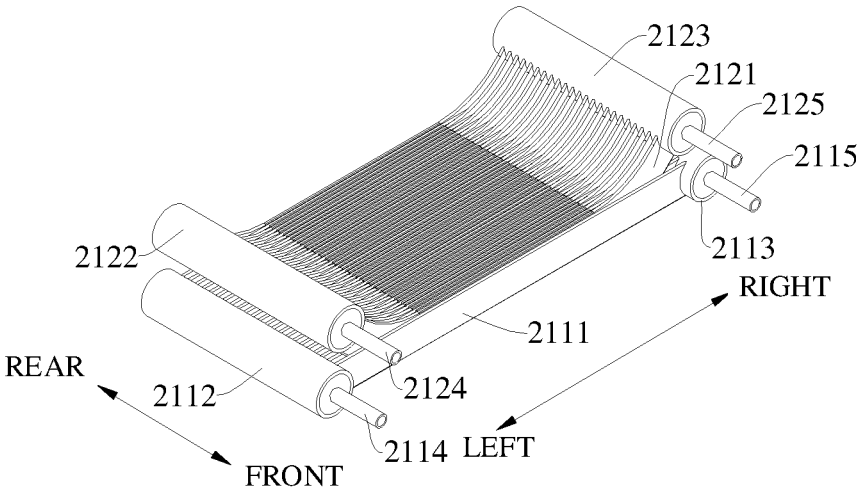
FIG. 16 is a schematic view of a first heat exchange assembly according to still another embodiment of the present disclosure.
Figure 17:
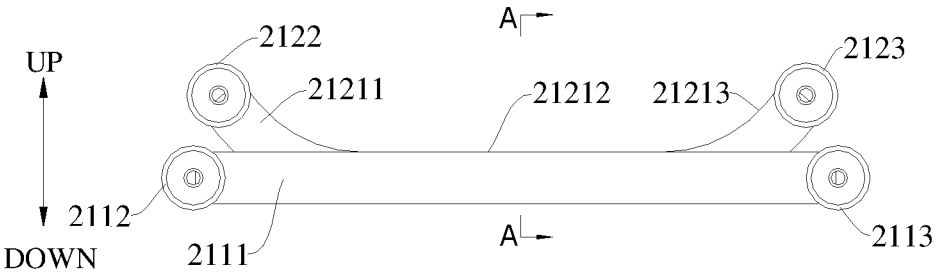
FIG. 17 is a front view of the first heat exchange assembly in FIG. 16.

As shown in FIGS. 16 and 17, the thickness direction of the first heat exchange tube 2111 and the thickness direction of the second heat exchange tube 2121 are each a front-rear direction, and the length direction of the first heat exchange tube 2111 and the length direction of a part of the second heat exchange tube 2121 are each the left-right direction. The plurality of first heat exchange tubes 2111 are arranged side by side in the front-rear direction, the plurality of second heat exchange tubes 2121 are arranged side by side in the front-rear direction, and the first heat exchange tubes 2111 and the second heat exchange tubes 2121 are arranged alternately in the front-rear direction.

It should be noted here that "alternating arrangement" should be understood broadly. For example, one or more second heat exchange tubes 2121 may be arranged between two adjacent first heat exchange tubes 2111; one or more first heat exchange tubes 2111 may be arranged between two adjacent second heat exchange tubes 2121. In addition, the plurality of first heat exchange tubes 2111 may be divided into a plurality of groups of first heat exchange tubes, and each group of first heat exchange tubes may include at least two first heat exchange tubes 2111. The plurality of second heat exchange tubes 2121 may be divided into a plurality of groups of second heat exchange tubes, and each group of second heat exchange tubes may include at least two second heat exchange tubes 2121. The groups of first heat exchange tubes may be alternated with the groups of second heat exchange tubes.

In some embodiments, the second heat exchange tube 2121 includes a first section 21211, a second section 21213 and an intermediate section 21212 located between the first section 21211 and the second section 21213. The first section 21211 is in communication with the intermediate section 21212 through a first bent portion, and the second section 21213 is in communication with the intermediate section 21212 through a second bent portion. A length direction of the first section 21211 is not colinear with a length direction of the intermediate section 21212, a length direction of the second section 21213 is not colinear with the length direction of the intermediate section 21212, and the length direction of the intermediate section 21212 is parallel to the length direction of the first heat exchange tube 2111.

As shown in FIGS. 16 and 17, the length direction of the first heat exchange tube 2111 is the left-right direction. A segment of the second heat exchange tube 2121 adjacent to a left end is bent upwards, and a segment of the second heat exchange tube 2121 adjacent to a right end is bent upwards, so as to form the first section 21211, the first bent portion, the intermediate section 21212, the second bent portion and the second section 21213 arranged sequentially from left to right. The length direction of the intermediate section 21212 is the left-right direction.

In some specific embodiments, a backing plate 213 is arranged between the first heat exchange tube 2111 and the intermediate section 21212 of the second heat exchange tube 2121, a first side face or a second side face of the intermediate section 21212 is connected to one side face of the backing plate 213, and the first side face 21111 or the second side face 21112 of the first heat exchange tube 2111 is connected to the other side face of the backing plate 213.

Figure 18:
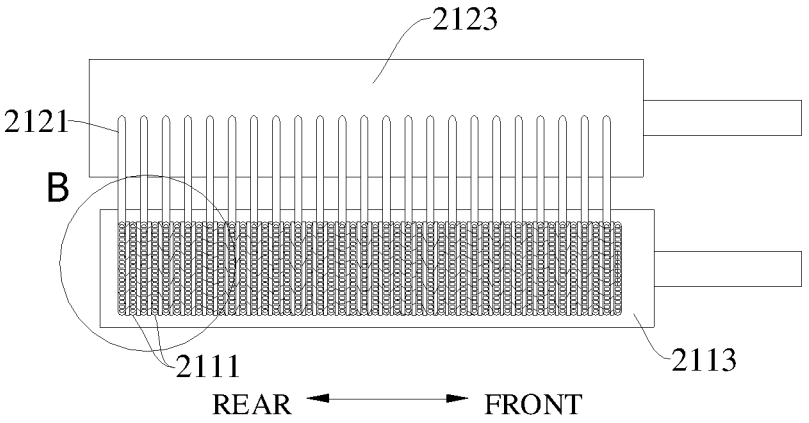
FIG. 18 is a sectional view of the first heat exchange assembly in FIG. 17 along line A-A.
Figure 19:
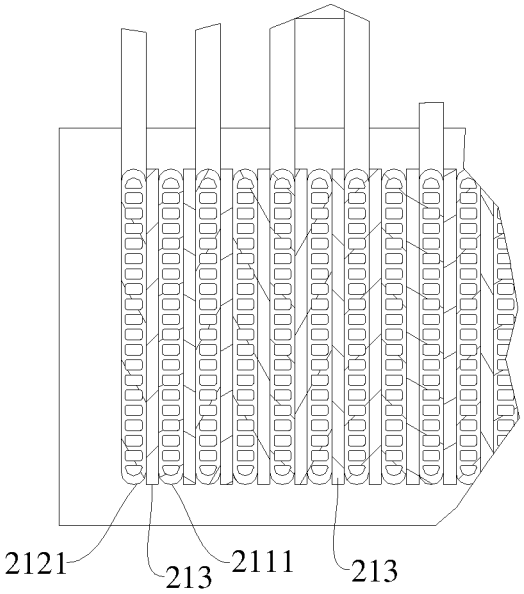
FIG. 19 is a partially enlarged view of the first heat exchange assembly in FIG. 18 at portion B.

As shown in FIGS. 18 and 19, the backing plate 213 is arranged between the intermediate section 21212 of the second heat exchange tube 2121 and the first heat exchange tube 2111 in the front-rear direction, a front side face of the intermediate section 21212 of the second heat exchange tube 2121 is in contact with a rear side face of the backing plate 213, and a front side face of the backing plate 213 is in contact with a rear side face of the first heat exchange tube 2111. By using the backing plate 213, a spacing between the first heat exchange tube 2111 and the second heat exchange tube 2121 may be within a reasonable range, so that a flat-tube groove on the header will not be deformed. Moreover, the first heat exchange tube 2111 and the second heat exchange tube 2121 are in contact with each other through the backing plate 213, so that the backing plate 213 may be preferentially corroded by adjusting an electric potential of the backing plate 213, so as to effectively improve the corrosion resistance of the first heat exchange tube 2111 and the second heat exchange tube 2121.

For the embodiment in which the second heat exchange tube 2121 is arranged in a pipe of the first heat exchange tube 2111, as shown in FIGS. 20 and 21, the second heat exchange tube 2121 may be a spiral tube, and the spiral tube 2121 is arranged in the pipe of the first heat exchange tube 2111, so as to increase a heat exchange area of the refrigerant in the second heat exchange tube 2121, thus improving the heat exchange efficiency.

Further, the second system 200 further includes a first connecting tube 2114 and a second connecting tube 2115, as well as a third connecting tube 2124 and a fourth connecting tube 2125. The first connecting tube 2114 is connected to one end of the first heat exchange tube 2111, and the second connecting tube 2115 is connected to the other end of the first heat exchange tube 2111. The third connecting tube 2124 is connected to one end of the second heat exchange tube 2121, and the fourth connecting tube 2125 is connected to the other end of the second heat exchange tube 2121.

In the description of the present disclosure, terms such as "an embodiment," "some embodiments," "an example," "a specific example," or "some examples," means that a particular feature, structure, material, or characteristic described in connection with the embodiment or example is included in at least one embodiment or example of the present disclosure. Thus, the appearances of these terms in various places throughout this specification are not necessarily referring to the same embodiment or example of the present disclosure. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

In the description of the present disclosure, "a plurality of" means at least two such as two or three, unless otherwise expressly and specifically defined.

In the present disclosure, unless otherwise expressly defined, terms such as "mounting," "interconnection," "connection," "fixing" shall be understood broadly, and may be, for example, fixed connections, detachable connections, or integral connections; may also be mechanical or electrical connections or intercommunication; may also be direct connections or indirect connections via intervening media; may also be inner communications or interactions of two elements. For those skilled in the art, the specific meaning of the above terms in the present disclosure can be understood according to the specific situations.

In addition, terms "first" and "second" are only used for descriptive purposes and cannot be understood as indicating or implying relative importance or implicitly indicating the number of indicated technical features. Thus, the features defined by "first" and "second" may include at least one of the features explicitly or implicitly.

In the present disclosure, unless otherwise expressly defined and specified, a structure in which a first feature is "on" or "below" a second feature may include an embodiment in which the first feature is in direct contact with the second feature, or may further include an embodiment in which the first feature and the second feature are in indirect contact through intermediate media. Furthermore, a first feature "on," "above," or "on top of" a second feature may include an embodiment in which the first feature is right or obliquely "on," "above," or "on top of" the second feature, or just means that the first feature is at a height higher than that of the second feature, while a first feature "below," "under," or "on bottom of" a second feature may include an embodiment in which the first feature is right or obliquely "below," "under," or "on bottom of" the second feature, or just means that the first feature is at a height lower than that of the second feature.

Although the embodiments of the present disclosure have been shown and described above, it can be understood that the above embodiments are exemplary and shall not be understood as limitation to the present disclosure, and changes, modifications, alternatives and variations can be made in the above embodiments within the scope of the present disclosure by those skilled in the art.

What is claimed is:

1. A heat exchange system for heat dissipation of an electronic control assembly of an air conditioning system, comprising:

a first heat exchange assembly comprising a first channel and a second channel isolated from each other, the second channel comprising a first communication port and a second communication port, the first heat exchange assembly comprising a first heat exchange tube and a second heat exchange tube, the first heat exchange tube comprising a tube wall and a flow channel, the flow channel of the first heat exchange tube defining a part of the first channel, the second heat exchange tube comprising a tube wall and a flow channel, the flow channel of the second heat exchange tube defining a part of the second channel, and at least part of the tube wall of the second heat exchange tube being in contact with at least part of the tube wall of the first heat exchange tube; and a heat exchange member comprising a first communication port and a second communication port, the first communication port of the heat exchange member being in communication with the first communication port of the second channel, the second communication port of the heat exchange member being in communication with the second communication port of the second channel, the heat exchange member comprising at least one heat dissipation surface, and the heat dissipation surface being in contact with the electronic control assembly, so as to be in conduction with the electronic control assembly to dissipate heat, wherein when the heat exchange system operates, the first channel is filled with a first refrigerant, the second channel is filled with a second refrigerant, and the first refrigerant in the first channel and the second refrigerant in the second channel remain separated from each other, wherein the heat exchange system has an in-use orientation in which the second communication port of the second channel is not lower than the first communication port of the second channel in a gravity direction, the second communication port of the heat exchange member is not lower than the first communication port of the heat exchange member in the gravity direction, the second communication port of the heat exchange member is lower than the second communication port of the second channel in the gravity direction, and the first communication port of the heat exchange member is lower than the first communication port of the second channel in the gravity direction.

2. The heat exchange system for heat dissipation of the electronic control assembly of the air conditioning system according to claim 1, wherein the first heat exchange tube and the second heat exchange tube are each a flat tube, the first heat exchange tube and the second heat exchange tube each comprise a first side face and a second side face arranged opposite to each other and a third side face and a fourth side face arranged opposite to each other, a distance between the first side face and the second side face of the first heat exchange tube is less than a distance between the third side face and the fourth side face of the first heat exchange tube, a distance between the first side face and the second side face of the second heat exchange tube is less than a distance between the third side face and the fourth side face of the second heat exchange tube, the first heat exchange tube and the second heat exchange tube each further comprise a plurality of flow channels spaced apart from each other, and at least part of the first side face or the second side face of the first heat exchange tube is in contact with at least part of the first side face or the second side face of the second heat exchange tube.

3. The heat exchange system for heat dissipation of the electronic control assembly of the air conditioning system according to claim 2, wherein a plurality of the first heat exchange tubes and a plurality of the second heat exchange tubes are provided, the plurality of the first heat exchange tubes are arranged along a thickness direction of the first heat exchange tube, the plurality of the second heat exchange tubes are arranged along a thickness direction of the second heat exchange tube, the thickness direction of the first heat exchange tube is substantially parallel to the thickness direction of the second heat exchange tube, the first heat exchange tube and the second heat exchange tube are alternately arranged along the thickness direction of the first heat exchange tube, and a length direction of the first heat exchange tube is parallel to a length direction of at least part of the second heat exchange tube.

4. The heat exchange system for heat dissipation of the electronic control assembly of the air conditioning system according to claim 3, wherein the second heat exchange tube comprises a first section, a second section and an intermediate section located between the first section and the second section, the first section is in communication with the intermediate section through a first bent portion, the second section is in communication with the intermediate section through a second bent portion, a length direction of the first section is not colinear with a length direction of the intermediate section, a length direction of the second section is not colinear with the length direction of the intermediate section, the length direction of the intermediate section is parallel to the length direction of the first heat exchange tube, a backing plate is arranged between the first heat exchange tube and the intermediate section of the second heat exchange tube, a first side face or a second side face of the intermediate section is connected to one side face of the backing plate, and the first side face or the second side face of the first heat exchange tube is connected to the other side face of the backing plate.

5. The heat exchange system for heat dissipation of the electronic control assembly of the air conditioning system according to claim 1, wherein the first heat exchange assembly further comprises:

a first header and a second header spaced apart from each other, one end of at least one of a plurality of the first heat exchange tubes in a length direction of the first heat exchange tube being connected to the first header, and the other end of the at least one of the plurality of the first heat exchange tubes in the length direction of the first heat exchange tube being connected to the second header, so as to communicate the first header with the second header;

a third header and a fourth header spaced apart from each other, one end of at least one of a plurality of the second heat exchange tubes in a length direction of the second heat exchange tube being connected to the third header, and the other end of the at least one of the plurality of the second heat exchange tubes in the length direction of the second heat exchange tube being connected to the fourth header, so as to communicate the third header with the fourth header.

6. An air conditioning system, comprising:

a first system comprising a compressor, a first heat exchanger, a second heat exchanger, and a first throttle, the compressor comprising a first opening and a second opening, the first heat exchanger comprising a first opening and a second opening, the first throttle comprising a first opening and a second opening, the second heat exchanger comprising a first opening and a second opening, the first opening of the first heat exchanger being in communication with the first opening of the compressor, the second opening of the first heat exchanger being in communication with the first opening of the first throttle, the second opening of the first throttle being in communication with the second opening of the second heat exchanger, and the first opening of the second heat exchanger being in communication with the second opening of the compressor; and a second system comprising a first heat exchange assembly, an electronic control assembly and a heat exchange member, the first heat exchange assembly comprising a first channel and a second channel isolated from each other, the first channel comprising a first communication port and a second communication port, the first communication port of the first channel being in communication with the second opening of the first throttle or the second opening of the first heat exchanger, the second communication port of the first channel being in communication with the second opening of the compressor and the first opening of the second heat exchanger, or the second communication port of the first channel being in communication with the second opening of the second heat exchanger, wherein the second channel comprises a first communication port and a second communication port, the heat exchange member comprises a first communication port and a second communication port, the first communication port of the heat exchange member is in communication with the first communication port of the second channel, the second communication port of the heat exchange member is in communication with the second communication port of the second channel, the heat exchange member comprises at least one heat dissipation surface, and the heat dissipation surface is in contact with the electronic control assembly, so as to be in conduction with the electronic control assembly to dissipate heat, wherein when the air conditioning system operates, the first system is filled with a first refrigerant, the second channel of the second system is filled with a second refrigerant, and the first refrigerant in the first system and the second refrigerant in the second system remain separated from each other, wherein the heat exchange system has an in-use orientation in which the second communication port of the second channel is not lower than the first communication port of the second channel in a gravity direction, the second communication port of the heat exchange member is not lower than the first communication port of the heat exchange member in the gravity direction, the second communication port of the heat exchange member is lower than the second communication port of the second channel in the gravity direction, and the first communication port of the heat exchange member is lower than the first communication port of the second channel in the gravity direction.

7. The air conditioning system according to claim 6, further comprising a first adjusting member, the first adjusting member comprising a first opening and a second opening, the first opening of the first adjusting member being in communication with the second opening of the first throttle and the second opening of the second heat exchanger, and the second opening of the first adjusting member being in communication with the first communication port of the first channel.

8. The air conditioning system according to claim 6, wherein the first heat exchange assembly comprises:

a first heat exchange tube comprising a tube wall and a flow channel, and the flow channel of the first heat exchange tube defining a part of the first channel; and a second heat exchange tube comprising a tube wall and a flow channel, the flow channel of the second heat exchange tube defining a part of the second channel, at least part of the tube wall of the second heat exchange tube being in contact with at least part of the tube wall of the first heat exchange tube, the first heat exchange tube and the second heat exchange tube are each a flat tube, the first heat exchange tube and the second heat exchange tube each comprising a first side face and a second side face arranged opposite to each other and a third side face and a fourth side face arranged opposite to each other, a distance between the first side face and the second side face of the first heat exchange tube being less than a distance between the third side face and the fourth side face of the first heat exchange tube, a distance between the first side face and the second side face of the second heat exchange tube being less than a distance between the third side face and the fourth side face of the second heat exchange tube, the first heat exchange tube and the second heat exchange tube each further comprising a plurality of flow channels spaced apart from each other, at least part of the first side face or the second side face of the first heat exchange tube being in contact with at least part of the first side face or the second side face of the second heat exchange tube.

9. The air conditioning system according to claim 8, wherein the first heat exchange assembly further comprises:

a first header and a second header spaced apart from each other, a plurality of the first heat exchange tubes and a plurality of the second heat exchange tubes being provided, one end of at least one of the plurality of the first heat exchange tubes in a length direction of the first heat exchange tube being connected to the first header, and the other end of the at least one of the plurality of the first heat exchange tubes in the length direction of the first heat exchange tube being connected to the second header, so as to communicate the first header with the second header; and a third header and a fourth header spaced apart from each other, one end of at least one of the plurality of the second heat exchange tubes in a length direction of the second heat exchange tube being connected to the third header, and the other end of the at least one of the plurality of the second heat exchange tubes in the length direction of the second heat exchange tube being connected to the fourth header, so as to communicate the third header with the fourth header.

* * * * *